United States Patent [19]

Zilbermann et al.

[11] 4,203,485

[45] May 20, 1980

[54] MULTIZONE AIR TERMINAL

[76] Inventors: Andre H. Zilbermann, 6421 Lavendale; Melvin S. Aronoff, 11230 Shelterwood La., both of Dallas, Tex. 75230

[21] Appl. No.: 960,584

[22] Filed: Nov. 13, 1978

Related U.S. Application Data

[63] Continuation of Ser. No. 751,734, Dec. 17, 1976, abandoned.

[51] Int. Cl.[2] ..... F24F 13/04

[52] U.S. Cl. ..... 165/2; 165/31; 236/13

[58] Field of Search ..... 98/38 B, 38 C; 165/2, 165/16, 22, 31; 236/13, 49

[56] References Cited

U.S. PATENT DOCUMENTS

| | | | |
|---|---|---|---|
| 1,949,735 | 3/1934 | Bulkeley | 165/16 |
| 2,194,694 | 3/1940 | Denker | 236/13 X |
| 2,238,689 | 4/1941 | Locke | 165/22 X |
| 2,292,335 | 8/1942 | Durbin | 165/22 |
| 2,575,907 | 11/1951 | Carlson | 236/13 X |
| 2,984,459 | 5/1961 | Waterfill | 165/22 |
| 3,521,700 | 7/1970 | Knowles et al. | 165/22 |
| 3,788,386 | 1/1974 | Demaray | 165/2 |
| 3,934,795 | 1/1976 | Ginn et al. | 236/13 |
| 3,951,205 | 4/1976 | Zilbermann | 165/16 |
| 3,994,335 | 11/1976 | Perkins | 236/13 X |

*Primary Examiner*—Gerald A. Michalsky

*Attorney, Agent, or Firm*—Richards, Harris & Medlock

[57] ABSTRACT

The invention provides an air terminal capable of serving multiple zones with either variable volume, constant temperature air or variable temperature, constant volume air, or both, without any reheating of cold air. The terminal consists of a cold air plenum and a return air plenum. The cold air plenum is served with cold air from a primary cold duct. The air is introduced into this plenum through a damper which is controlled by a regulator for maintaining a constant pressure in the cold air plenum. The return air plenum is supplied with return air by a constant pressure recirculating fan mounted in the terminal. Constant volume, variable temperature air is supplied to the zones through thermostatically controlled mixing dampers which mix air from the cold plenum with air from the return plenum. A heating unit downstream from the mixing dampers selectively raises the temperature of the air provided to a zone. The heating is controlled in sequence with the mixing operation so that only return air can be heated. Constant temperature variable volume air supply is provided from the central terminal to serve zones that neither require heat or zones with controlled heat available from another source. In another embodiment, a hot air plenum is installed in fluid communication with the air in the return air plenum. A mixing damper mixes return air and hot air when the cold air dampers are completely closed off to provide heating to a particular zone.

18 Claims, 6 Drawing Figures

MULTIZONE AIR TERMINAL

This is a continuation of application Ser. No. 751,734 filed on Dec. 17, 1976 now abandoned.

BACKGROUND OF THE INVENTION

1. Field of the Invention

The present invention relates generally to improvements in air-conditioning systems and more particularly to the use of an air terminal from which conditioned air is directed to the various zones being serviced by the air-conditioning system.

2. Prior Art

Present day heating and air-conditioning systems must be capable of controlling the temperature of many spaces within a building complex which have different cooling and heating requirements and characteristics. Some exterior spaces with an abundance of glass and on the shaded side of a building may require full heating capacity while those on an unshaded side or on a side predominantly exposed to the sun may require cooling. Simultaneously, interior surfaces always require cooling with the cooling requirement being governed by the number of people, amount of lighting and other sources of heat in the space involved.

Various air-conditioning systems have been used to handle this problem. One of the most inefficient systems now in wide use provides full cooling throughout the building and reheats this cold air to prevent overcooling any of the zones. While this type of system has a rather low initial cost, the inefficiency of such a system which uses energy to cool air and then energy to reheat the air is self evident. Thus, the system is very expensive to operate, and in fact, high energy cost will soon eliminate use of this design.

Another system in use utilizes a double duct terminal in which cold and warm air are mixed to provide air at the proper temperature to meet the heating or cooling requirements of a particular zone. This system has a relatively high initial cost and is also expensive to operate due to their relatively low efficiency. In this, and the previously described system, during building warm-up periods, as well as other times when heat is required to maintain a minimum temperature, as when the building is not occupied, the entire air distribution system must be operated, thus adding to the operating cost of the unit.

Another method incorporates variable volume, constant temperature air terminals which vary the quantity of air supplied to the interior zones of a building. In this system, the exterior zones are served by constant volume variable temperature terminals utilizing powered mixing boxes of the type covered by this inventor's prior U.S. Pat. No. 3,951,205. While this system is inexpensive initially and operating costs are relatively low, it envisions the use of several spaced air terminals positioned throughout the building complex which is serviced by it.

SUMMARY OF THE INVENTION

The present invention provides a system which overcomes many of the limitations of these prior art systems by the use of an air terminal having the capability of serving multiple zones with either variable volume, constant temperature air or variable temperature, constant volume air, or both, without any reheating of cold air.

The terminal consists of a cold air plenum and a return air plenum. The cold air plenum is served with cold air from a primary cold duct. The air is introduced into this plenum through a damper which is controlled by a regulator for maintaining a constant pressure in the cold air plenum. The return air plenum is supplied with return air by a constant pressure recirculating fan mounted in the terminal. This fan maintains a constant pressure of recirculated air in the return air plenum.

In order to supply constant volume, variable temperature air to the zones requiring it, mixing dampers are installed which mix air from the cold plenum with air from the return plenum. These dampers are operated by thermostatically controlled damper motors. Any number of mixing dampers can be installed so that the terminal becomes a constant volume, variable temperature multi-zone-air source.

By inserting a heating element downstream from the mixing dampers, the system can further raise the temperature of the air serving a zone and thus provide heating to any zone that requires heat. The heating is controlled in sequence with the mixing operation so that only return air can be heated. This eliminates the inefficiency that results from heating primary air that has been cooled either by refrigeration or otherwise.

Constant temperature variable volume air supply is provided from the central terminal to serve zones that neither require heat, such as interior spaces, or zones with controlled heat available from another source. A connection is made to the cold air plenum, and a motorized damper controlled from a zone thermostat meters the quantity of air required to satisfy the cooling requirements of the zone.

The terminal of this system can accommodate any number of variable temperature air zones or variable volume air zones or any combination of the two. Moreover, the use of a multizone air terminal substantially reduces initial cost of the systems as only one duct connection need be made to the primary duct system regardless of the number of zones served by the terminal. Also, only one electrical connection and one pressure reducing station is required for each terminal.

In another embodiment of the invention, a hot air plenum is installed in the terminal in addition to the cold air and return air plenums. This is accomplished by the installation of a heating element in a hot air plenum in fluid communication with the air in the return air plenum. A mixing damper mixes return air and hot air when the cold air dampers are completely closed off to provide heating to a particular zone. This embodiment permits the use of one heating element to serve a number of zones and continues to prevent the waste of energy caused by mixing heated air with air that has been cooled.

DESCRIPTION OF THE DRAWINGS

For a more complete understanding of the present invention, and further details and advantages thereof, reference is now made to the following description taken in conjunction with the accompanying drawings in which.

DESCRIPTION OF THE PREFERRED EMBODIMENTS

Figure 1:
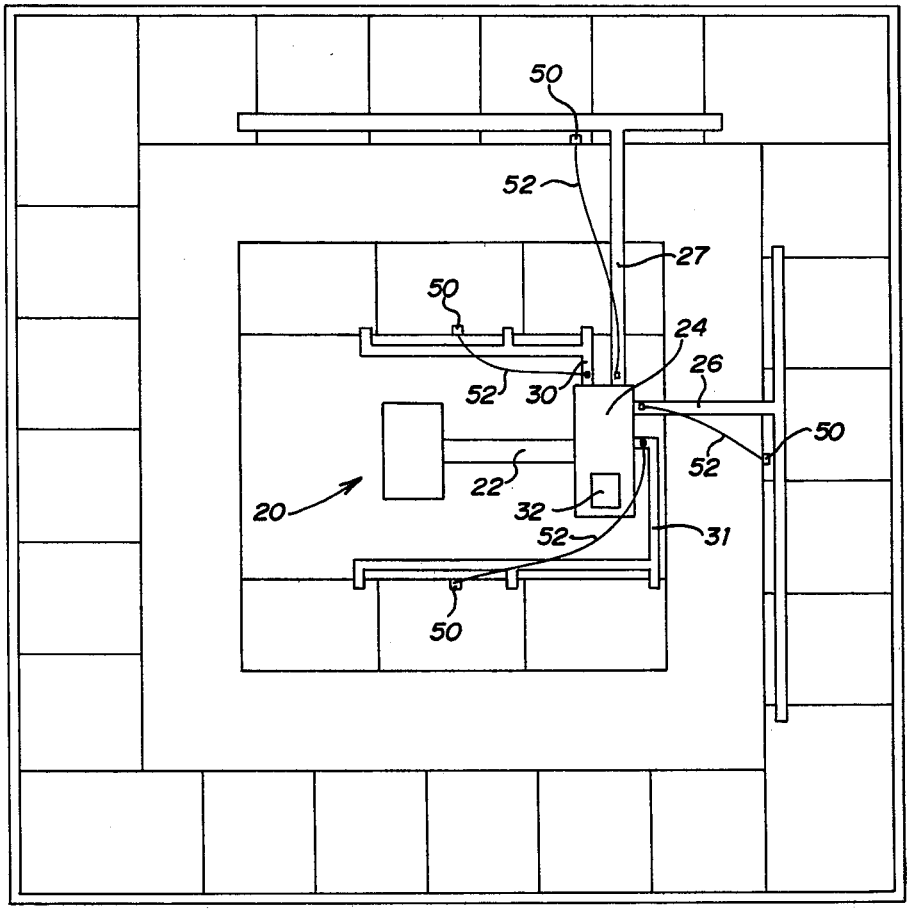
FIG. 1 is a diagrammatic view showing the system of the present invention installed in a building.

Referring to FIG. 1, there is shown a central cooling or air-conditioning unit indicated generally by the reference 20 for providing a supply of cool primary air. This central cooling unit is located at any central location of a building and can be one of many commercially available units which generate a volume of cold air to be used to cool individual rooms through an appropriate duct system. This central cooling unit can be powered by any suitable power source available in the building and need only be of a size capable of providing a sufficient amount of cold air as required to cool the rooms which it services in accordance with the present invention.

The central cooling unit 20 is connected by a duct 22 to the air terminal 24 of the present invention. The central cooling unit is provided with a blower (not shown) which causes the cold air to flow into and through duct 22 into air terminal 24. In accordance with one embodiment of the present invention, ducts 26, 27, 30 and 31 carry air from air terminal 24 to the various rooms within the building in accordance with the heating and cooling requirements of each room. Ducts 30 and 31 supply only interior rooms while duct systems 26 and 27 supply conditioned air to rooms around the exterior of the building. An inlet 32 is provided in air terminal 24 and receives return air to the air terminal for use in the invention as will be hereinafter discussed in greater detail.

Thermostat systems 50 are appropriately positioned in each room or at selected zone areas and are connected through lines 52 to air terminal 24 to control the temperature of air provided to the rooms in accordance with the need for cooling or heating each room.

Although FIG. 1 illustrates the use of a single air terminal having four ducts 26, 27, 30 and 31 for supplying conditioned air to the exterior rooms on two sides of a building and to the interior rooms, it will be understood and appreciated from the following description of the present invention that the number of ducts extending from air terminal 24 may be increased or decreased according to the needs of a particular building and likewise a plurality of air terminals may be used where a great number of differing rooms are to be heated and cooled by the present system. For example, a separate air terminal, supplied with cool air from a common cooling unit, could be used to furnish conditioned air to the exterior rooms on the remaining two sides of the building illustrated in FIG. 1.

Referring to FIGS. 2–5, air terminal 24 is divided into an upper plenum 60 and a lower plenum 62. Upper plenum 60 is served with cold air from the central air-conditioning unit 20 through duct 22. Cool air is introduced into upper plenum 60 through an inlet damper 64. Damper 64 is controlled by a actuator 66 through linkage 68 which opens and closes damper 64 to maintain a constant pressure in upper plenum 60. The flow of cold air from air-conditioning unit 20 and out of upper plenum 60 is indicated generally by arrows 70. Lower plenum 62 is supplied with return air by a constant pressure recirculating fan 72 which is mounted in air terminal 24. Recirculating fan 72 maintains a constant pressure of recirculating air into lower plenum 62. Air is drawn by fan 72 through filters 73 and blown into lower plenum 62. The flow path of air into and out of lower plenum 62 is indicated generally by arrows 74.

Figure 5:
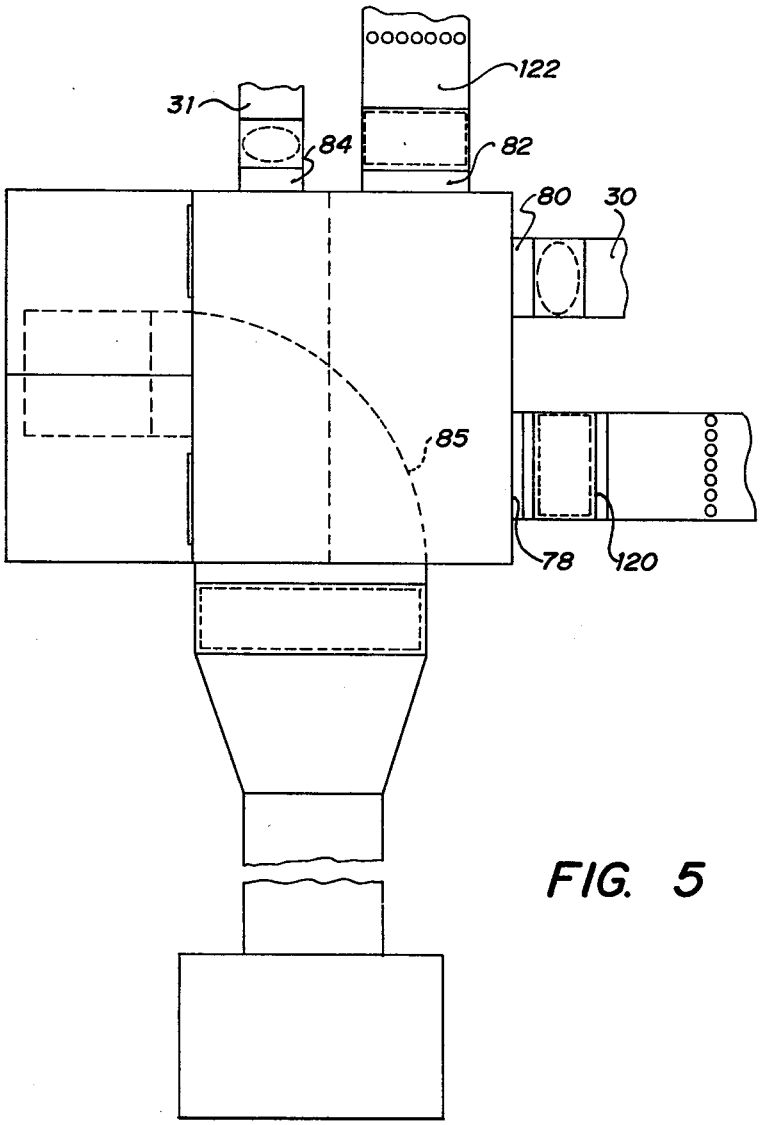
FIG. 5 is a plan view of the system illustrated in FIG. 3.

Upper plenum 60 is provided with a plurality of openings 78, 80, 82 and 84 (FIG. 5). A perforated metal defusion plate 85 is mounted across the opening into upper plenum 60 to more evenly direct the air to the various openings 78, 80, 82 and 84 formed out of upper plenum 60. Lower plenum 62 is provided with an opening 86 immediately below opening 78 of upper plenum 60 and adjacent thereto and an opening 88 (FIG. 4) immediately below and adjacent to opening 82 of upper plenum 60. Each of the openings 78–88 permits the flow of air from upper or lower plenum 60 and 62, and communicates with an appropriate room in the building serviced by the present unit through an appropriate ducting system now to be described.

Figure 2:
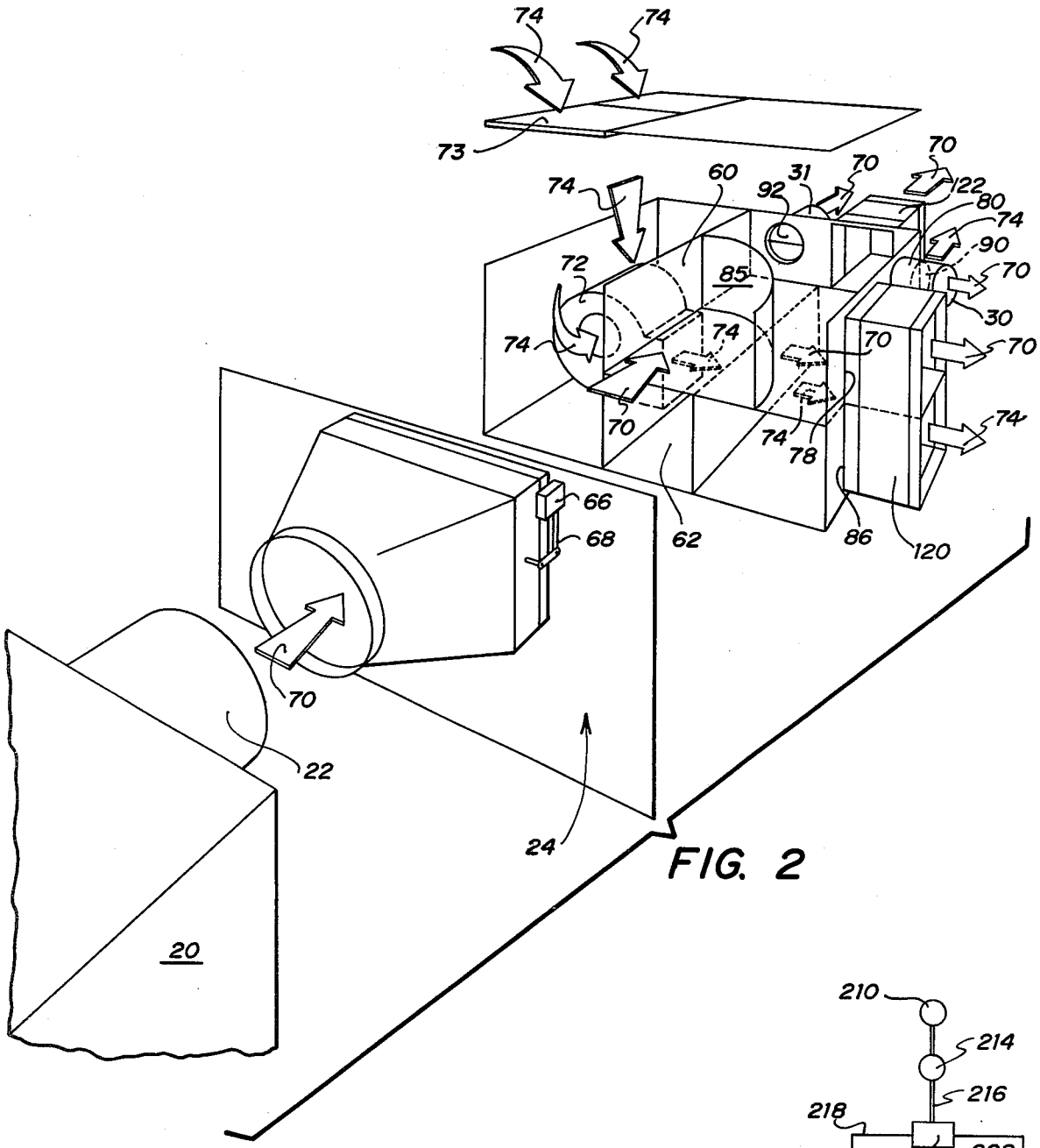
FIG. 2 is a perspective cut away view of an air-conditioning system of the present invention.

Openings 80 and 84 communicate air from upper plenum 60 by way of ducts 30 and 31, respectively (FIGS. 1 and 2). Each of the ducts 30 and 31 is provided with a damper 90, and 92, respectively. As will be hereinafter discussed in greater detail, dampers 90 and 92 are operated by thermostatically controlled damper motors which meter the flow of air through these conduits as required to cool the room associated therewith.

Figure 3:
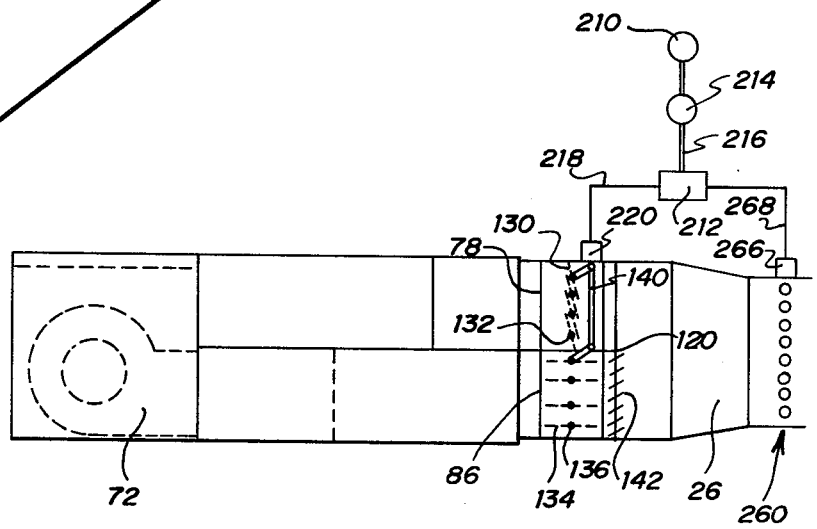
FIG. 3 is a side elevation of the system illustrated in FIG. 2.
Figure 4:
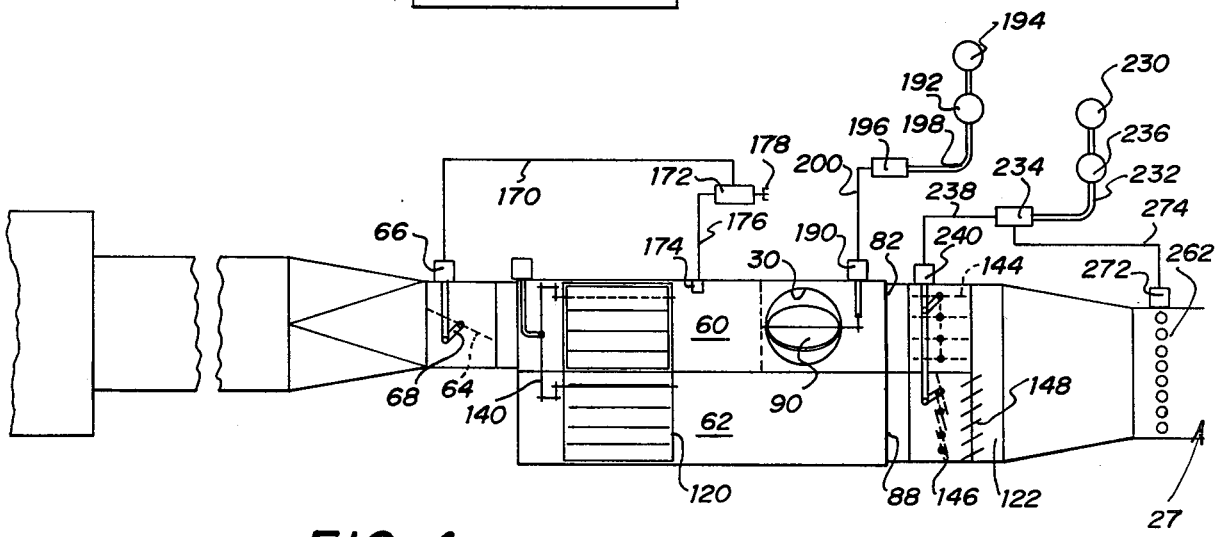
FIG. 4 is an end elevation of the system illustrated in FIG. 3.

A mixing damper 120 is mounted to air terminal 24 over opening 78 and 86 in upper and lower plenums 60 and 62, respectively. Likewise, a mixing damper 122 is mounted to receive the air from openings 82 and 88 in upper and lower plenum 60 and 62, respectively. Referring now to FIGS. 3 and 4, mixing damper 120 is fitted with a plurality of upper damper elements 130 rotatable about axis shafts 132. A plurality of lower damper elements 134 are fitted in mixing damper 120 adjacent opening 78. Damper elements 134 are supported for movement about axis shafts 136. Damper elements 130 are interconnected so that they operate in unison. Likewise, damper elements 134 are interconnected to operate in unison. A connection linkage 140 (FIG. 4) interconnects elements 130 and 134 so that movement of linkage 140 operates both damper elements at once. However, linkage 140 is so arranged that when damper elements 130 are in a closed position, damper elements 134 are open. Likewise, when damper elements 134 are in a complete closed position, damper elements 134 are in a full open position. A back-draft or barometric type damper 142 is fitted in mixing damper 120, downstream of damper elements 134 and adjacent opening 86 from lower plenum 62.

Mixing damper 122 is arranged similarly to that structure described with respect to mixing damper 120. Specifically, mixing damper 122 is provided with a plurality of upper damper elements 144 and lower damper elements 146. Elements 144 are interconnected to act in unison, and damper elements 146 are interconnected to act in unison. Elements 144 and 146 are interconnected to operate simultaneously such that damper elements 146 are in a full closed position when damper elements 144 are in a full open position and such that damper elements 146 are in an open position when damper elements 144 are closed. Therefore, mixing dampers 120 and 122 are set such that the opening from the lower plenum is in a full open position when the opening from the upper plenum is in a full closed position, to the reverse where the upper opening is in a full open position and the lower opening is in a full closed position, and any variation therebetween. A back-draft or barometric type damper 148 is fitted in mixing damper 122, downstream of damper elements 146 and adjacent opening 88 from lower plenum 62.

Referring now to FIG. 4, air terminal 24 is shown with control systems attached to its various elements. Actuator 66 shown connected to inlet damper 64 by linkage 68 is connected by a line 170 to a pressure sensitive switch 172. A pressure sensor 174 is mounted within upper plenum 60 and measures the pressure within this plenum throughout the operation of the system. Pressure sensor 174 is connected to pressure sensitive switch 172 by a line 176. Switch 172 is fitted with an adjustment means 178 which permits the selective control of the pressure at which switch 172 is closed to activate actuator 66. In operation, if the pressure within upper plenum 60 is below a chosen setting, switch 172 activates actuator 66 to open damper 64 thereby permitting increased flow of cold air into the upper plenum. When the pressure within upper plenum 60 reaches the desired setting, switch 172 is opened and actuator 66 deactivated. In this manner, damper 64 is set at a position corresponding to the chosen setting.

As the pressure rises above the desired setting, switch 172 is again closed causing the reversed actuation of actuator 66, closing damper 64 and thereby adjusting the flow of cold air into the upper plenum. This arrangement maintains a constant pressure within upper plenum 60 regardless of the setting of the dampers permitting the outflow of air from the upper plenum. Likewise, fan 72 is a constant pressure recirculating blower unit thereby maintaining a constant pressure of recirculated air to the lower plenum 62. In this way, air terminal 24 provides, at all times, a chamber of constant pressure air to the duct systems attached therefrom. It will now be appreciated that this is the case regardless of the number of ducts attached to air terminal 24. By maintaining a constant pressure air source in the air terminal, opening or closing of dampers of a particular terminal or changes in the primary air pressure do not adversely affect the accuracy of the temperature control of the various zones.

An actuator 190 is mounted adjacent duct 30 and is mechanically connected to damper 90 to control the movement of the damper. In the present embodiment, this actuator is of the type which is well known in the art and is operated by an electrical control signal in response to a thermostat 192 positioned in a room or zone to which air from duct 30 is supplied. Thermostat 192 is positioned in the room or zone and senses the temperature therein. In one embodiment of the invention, this thermostat is of the type which is connected to a control air supply 194 and in turn regulates the transmission of this pressurized air to operate a pressure sensitive relay 196 in response to the change of temperature within the room or zone. Relay 196 is connected to air supply 194 by a line 198. The pressure sensitive relay 196 is also connected to actuator 190 by electrical line 200.

In operation, when the thermostat 192 senses that the temperature in the room or zone is above the desired maximum, pressure will be transmitted to the pressure sensitive relay 196 through line 198. Relay 196 will in turn operate electrical contacts therein to supply electrical control signals through electrical line 200 to appropriately operate actuator 190 which in turn controls the position of damper 90. Because pressurized cool air is present in the upper plenum 60, thermostat 192, relay 196 and actuator 190 cooperate to appropriately control the damper 90 to open when the temperature in the room or zone is above a desired maximum and to close damper 90 when the temperature in the room falls below a desired maximum. In this manner, these elements control the flow of air from the upper plenum into the room or zone to control the temperature therein.

Damper elements 132, 134 and 144 and 146 of mixing dampers 120 and 122, respectively, are operated by similar thermostat controlled systems. Referring specifically to mixing damper 120, an air supply 210 is connected to a pressure sensitive relay 212 with a thermostat 214 connected within the line 216 between air supply 210 and relay 212 to control the flow of air pressure therebetween. Relay 212 is in turn connected by electrical line 218 to an actuator 220 which is mechanically connected through linkage 140 to damper elements 130 and 134. Thermostat 214 is positioned in a selected room or zone and is set to permit the flow of control air from supply 210 to relay 212 when the temperature rises above a predetermined level. Relay 212 supplies an electrical control signal to actuator 220 which in turn operates damper elements 130 and 134 through linkage 140 to appropriately control the mixture of cool air from the upper plenum and return air from the lower plenum through mixing damper 120 and into duct 26.

Alternatively, duct 26 connected to mixing damper 120 may be operated as a variable volume, constant temperature air supply source by shutting off blower 72 thereby only supplying cool air from upper plenum 60 past damper elements 130 and out of mixing damper 120. In this arrangement, the thermostat controls the position of damper elements 130 to meter cool air through mixing damper 120 and into the zone to which air is supplied. Although the lower damper elements 134 of mixing damper 120 are partially in an open position when damper elements 130 are in a partial open position, the back draft of cool air into lower plenum 62 is prevented by back draft damper 142. Back draft damper 142 is the type controlled by the pressure difference on opposite sides of the damper unit. Thus, when fan 72 is shut off, the damper is in a closed position to prevent the back draft of air from mixing damper 120 into lower plenum 62.

At a pre-selected setting, as damper elements 130 controlling the flow of cool air from upper plenum 60 are closed down, a signal from actuator 220 to fan 72 activates the fan to deliver air through lower plenum 62 past damper elements 134 and back draft damper 142 into the mixing damper 120. As a result, the area or zone supplied by air through mixing damper 120 may be furnished a quantity of constant temperature, controlled volume air to a pre-selected setting. Up to this setting, fan 72 need not be operated thereby providing improved efficiency in the system. Likewise, this capability adds to the versatility of the unit permitting the supply of both a variable volume, constant temperature supply of air or a constant volume, variable temperature supply of air to the zones furnished air through mixing damper 120. It will be appreciated that the operation that this alternative method of operation is similarly applicable to mixing damper 122.

A thermostat controlled system is provided for controlling damper elements 144 and 146 within mixing damper 122 identical to that described with respect to damper elements 132 and 134 in mixing damper 120. An air supply 230 is connected by way of conduit 232 to a pressure sensitive relay 234. A thermostat 236 is connected within conduit 232 to control the flow of pressure therein. Relay 234 is connected by electrical lead 238 to an actuator 240 mechanically connected to damper elements 144 and 146 of mixing damper 122. Thermostat 236 is positioned in a room or zone and permits the flow of air pressure from supply 230 to relay 234 in response to the change of temperature within the room or zone. Relay 234 generates an appropriate signal through electrical lead 238 to actuator 240 in response to temperature changes noted by thermostat 236 to move damper elements 144 and 146 to vary the mixture of air from the upper and lower plenum through mixing damper 122 to appropriately cool the room or zone being supplied by this portion of the system.

While the units for controlling dampers 90, 92, 120 and 122 have been described as combination pneumatic-electrical units, it is envisioned that any number of types of control systems including an all electric unit or an all pneumatic unit may be substituted for the units disclosed in this preferred embodiment without deviating from the essence of the present invention.

Heater units 260 and 262 are positioned downstream of mixing dampers 120 and 122 in ducts 26 and 27, respectively. Heater units 260 and 262 may be either the hot water or electric coil type now presently used in the trade. The units have the capacity for heating the air passing through ducts 26 and 27 thereby supplying desired heat to the rooms serviced by these conduit systems.

The operation of heater unit 260 is controlled by an actuator 266 attached to the outer surface of duct 26. Actuator 266 is connected by an electrical lead 268 to pressure sensitive relay 212. Thus, when thermostat 214 indicates a temperature in its respective room or zone as being below the setting desired, and provided actuator 220 has completely closed damper elements 130 to block all cold air coming from the upper plenum 60, relay 212 provides a signal to actuator 220 to actuate heater unit 260 to thereby heat the air flowing through conduit 26. It is a significant aspect of the present invention that heater unit 260 is only operated when damper elements 130 controlling the flow of cold air from the upper plenum 60 is in a completely closed position. This arrangement avoids the heating of cold air and thereby greatly improves the efficiency of the system. Similar to the control of heater unit 260, heater unit 262 in duct 27 is controlled by an actuator 272 which is connected by an electrical lead 274 to relay 234. Heater unit 262 is only actuated to provide heat to the air flowing through duct 27 when damper elements 144 controlling the flow of cold air from upper plenum 60 is in a completely closed position. Again, this arrangement greatly improves the efficiency of the system by avoiding heating of air which has been previously cooled.

It will be noted that ducts 30 and 31 leading from openings 80 and 84 in the upper plenum 60 service only interior rooms within the building or rooms where a heated air supply is not required. Therefore, these ducts provide a constant temperature, variable volume air supply from the upper cold air plenum having the capability of adjusting the temperature of those rooms supplied by varying the volume of air supplied therethrough. It will be appreciated that the rooms served by duct arrangements such as 30 and 31 are those rooms generally not requiring heat because of their particular position or use within the building.

Those rooms, where a combination of cooling and heating is required, such as the exterior rooms in a building, are serviced by the variable temperature, constant volume ducts 26 and 27 as has been heretofore described. These ducts provide a system for mixing cold air from upper plenum 60 and return air from lower plenum 62. Additionally, where heating is needed, the cold plenum is completely shut off, and return air is heated by heating units downstream in the ducts and thereafter supplied to the rooms serviced by these ducts.

The improved efficiency of the present invention can now be better appreciated. The system provides a central, single air terminal where the pressure in the upper and lower chambers may be maintained at a desired constant pressure. From the single air terminal, a plurality of air ducts provide air to any zone serviced by the air-conditioning system. Certain of the ducts provide for mixing of air from the upper cold air plenum and the lower return air plenum as required to appropriately maintain a desired temperature within the area serviced by these ducts. Additionally, return air may be heated to provide heat for the area serviced by these ducts. Those areas within a building not requiring heated air are supplied by a variable volume, constant temperature system which taps air from the upper cold air plenum only but meters the air furnished to the room or zone serviced by this duct system by thermostatically controlled dampers.

A primary benefit of the present system is that the relatively sophisticated pressure control apparatus is only necessary at the central air terminal. The duct system furnishes any combination of conditioned air, from cold air to heated return air from this air terminal to the particular rooms or zones serviced by the system. Additionally, the inefficient practice of heating cold air in order to provide heated air to a room or zone is eliminated by the arrangement which prohibits actuation of the heating unit unless the damper controlling the flow of air from the cold plenum is in a full closed position. It is therefore evident that those rooms or zones requiring heating can be furnished heat without actuating the main unit furnishing primary cold air to the air terminal.

Figure 6:
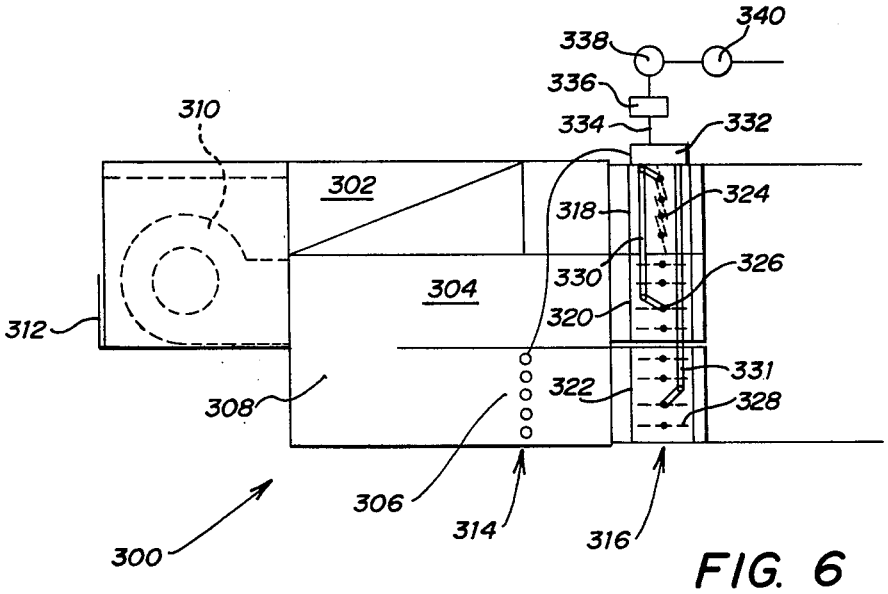
FIG. 6 is a side elevation of an alternative embodiment of the invention incorporating a hot air plenum in the air terminal.

FIG. 6 illustrates an alternative embodiment of the present invention wherein the heating units are positioned in a third plenum immediately below and communicating with the return air plenum. In this embodiment, an air terminal 300 includes an upper cold air plenum 302 which receives cold air from an airconditioning unit, an intermediate return air plenum 304, and a lower heater plenum 306. Plenums 304 and 306 have a common chamber 308 therebetween. A blower or fan 310 draws air through a filter 312 and discharges it into chamber 308. A heating unit 314 is positioned in plenum 306 and is activated to heat air passing therethrough as desired.

A mixing damper 316 is attached to air terminal 300 and surrounds openings 318, 320 and 322 in the upper, intermediate and lower plenums, respectively. A plurality of damper elements 324 are positioned adjacent opening 318 from upper cold air plenum 302. Similarly, a plurality of damper elements 326 and 328 are positioned adjacent openings 320 and 322 of intermediate and lower plenums 304 and 306, respectively. Damper elements 324, 326 and 328 are controlled by linkage systems 330 and 331 controlled by an actuator 332. Actuator 332 is connected by electrical lead 334 to a pressure sensitive relay 336. A thermostat 338 is positioned in the room or zone to be served by the air flowing through mixing damper 316 and controls the flow of pressurized air from an air supply 340 to relay 336 in response to the temperature in the room or zone. Thus, when the temperature in the room or zone exceeds a predetermined level, an air supply is provided to relay 336 and an electrical impulse is directed from relay 336 to actuator 332 to open damper elements 324 while closing damper elements 326 and 328. In this configuration, cool air in plenum 302 is supplied through mixing damper 316 and to the room or zone served by the system. As the temperature in the room is lowered, the thermostat reflects this change in temperature by varying the air pressure to relay 336 which in turn directs a control impulse to actuator 332 to close damper elements 324 and to open damper elements 326. In this way, a mixture of cool air and return air is supplied through mixing damper 316.

When the temperature in the room or zone drops below a predetermined level as set by the thermostat, air pressure to relay 336 is again altered and a control impulse is directed to actuator 332. At a predetermined pressure, corresponding to a predetermined temperature in the room, damper elements 324 are completely closed and heater unit 314 is activated in conjunction with the opening of damper elements 328. In this mode, no cold air is being discharged through mixing damper 316 while a mixture of air is discharged through opening 320 and through opening 322 past heater unit 314.

Where the temperature indicated by the thermostat is substantially below a desired point, the pressure permitted from air supply 340 to relay 336 is further varied to produce a control impulse through lead 334 to actuator 332 resulting in the closing of damper elements 326 and the full opening of damper elements 328. In this configuration, air directed from fan 310 is forced through opening 308 into lower plenum 306 and past heater unit 314 into mixing damper 316. Thus, all of the air flowing into the conduit serviced by the unit is moved past heater unit 314 thereby supplying heat to the room or zone.

In this embodiment, it will again be appreciated that there is a single air terminal for supplying conditioned air to the various rooms and zones being serviced. While FIG. 6 only illustrates a single mixing damper 316, it is to be understood that a plurality of these mixing dampers may be fitted to air terminal 300, and likewise constant temperature variable volume air supplies may be furnished from upper cold air plenum 302 as described in detail with respect to FIGS. 1–5. Moreover, it is to be understood that fan 310 is a constant pressure recirculating fan which maintains a constant pressure of recirculated air in the intermediate and lower plenums 304 and 306. Likewise, upper plenum 302 is provided with a pressure sensor for controlling an inlet damper which maintains a constant pressure within upper cold air plenum 302 as discussed with respect to the embodiment described in FIGS. 1–5.

Therefore, it will be appreciated that in this embodiment of the invention, there is again provided a single air terminal in which the air supplied therein is maintained at a constant pressure regardless of the outflow of air therefrom into the various duct systems. In this way, the equipment required to maintain a constant air pressure source is reduced to a minimum and is maintained at a central location. Likewise, the system does not permit the heating of cooled air but more efficiently provides elements which heat return air when heating is required from the system.

Therefore, the present invention provides a system including a single air terminal having the capability of serving multiple zones with either variable volume, constant temperature air or variable temperature, constant volume air, or both, without any reheating of cold air. The present inventions use of a single air terminal having this capability reduces initial cost substantially as only one duct connection need be made to the primary air-conditioning unit regardless of the number of zones or rooms served by the terminal. Moreover, only one electrical connection and one pressure controlled station is required for each terminal. Additionally, the present system provides for a full range of cooling and heating from the single air terminal while eliminating completely the need for heating cooled air as is now the practice in presently used air-conditioning systems.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of part and elements as fall within the scope of the appended claims.

What is claimed is:

1. In an air conditioning and distribution apparatus which receives air from a primary cool air source and return air from spaces to which conditioned air is to be distributed, the improvement comprising:

a first chamber having an inlet for receiving air under pressure from the primary cool air source and a first outlet communicating with one of the spaces to be supplied with conditioned air;

a second chamber having an inlet for receiving return air from one of the spaces and an outlet for discharging air therefrom to one of the spaces to be conditioned;

fan means in said second chamber for pressurizing the return air;

a first conduit communicating air from the outlets of said first and second chambers to a space to be conditioned; and valve means interposed between the first and second chambers and said first conduit for selectively admitting air from the outlet of said first chamber and air from the outlet of said second chamber to said first conduit communicating with the space, said valve means serving to admit only air from the outlet of the first chamber to the space when maximum cooling of air to the space is required, serving to blend air from the outlet of said first chamber and the outlet from said second chamber when less than maximum cooling is required and to admit only air from the outlet of said second chamber when heating of the air in the conduit is required, thereby providing a unit which permits conditioning of the air and eliminates heating of previously cooled air.

2. The apparatus of claim 1, including:

means for heating air flowing from the second chamber when only air from the second chamber is being directed to the space to be conditioned.

3. The apparatus of claim 2 wherein said first chamber includes:

a second outlet;

a cool air conduit for communicating air from said second outlet to a second space; and valve means interposed between said first chamber and said space for controlling the flow of air in said cool air conduit to provide a source of relatively constant temperature variable volume air to said second space.

4. The apparatus of claim 2, wherein said valve means includes:

first valve means in the first outlet of said first chamber;

second valve means in the outlet of said second chamber; and means coordinating the action of said first and second valve means so that the flow in said first conduit is a relatively constant volume of air, the temperature of which can be varied.

5. In a method of conditioning and distributing air received from a first primary cool air source and a second return air source, which return air is obtained from the spaces to be supplied with conditioned air, the improvement comprising:

directing said cool air from said primary cool air source, under pressure, to a first chamber having a first outlet;

directing said return air, under pressure, to a second chamber having a first outlet;

controlling the flow from the first outlet of the first and second chambers to permit flow only from the first outlet of the first chamber when maximum cooling of air to be supplied to a space is needed, to blend air from the first outlet of the first and second chambers when less than maximum cooling is needed and to permit flow only from the first outlet of the second chamber when heated air to the space to be conditioned is needed; and directing the air so controlled to the space to be conditioned.

6. The method of claim 5, including:

controlling the flow from the first outlets of the first and second chambers to produce a relatively constant volume air stream, the temperature of which can be varied by varying the amount of flow through the first outlets.

7. The method of claim 6, including:

heating of the air directed to the space from the second chamber when flow from the first outlet of the first chamber has been blocked and flow from the first outlet of the second chamber is being directed to the space to be conditioned.

8. The method of claim 5, including:

heating of the air directed to the space from the second chamber when flow from the first outlet of the first chamber has been blocked.

9. The method of claim 5, including:

directing air from said first chamber through a second outlet to a second space; and controlling the rate of flow to the second space to provide a stream of constant temperature, the volume of which can be changed.

10. An air conditioning system for supplying conditioned air to a first and a second zone, comprising:

a first control chamber having an inlet and first and second outlets;

a first means for supplying air at a selected temperature to the inlet of said first control chamber;

a second control chamber having an inlet for receiving air therein and having a first outlet, said second control chamber not being in fluid communication with said first air supply means;

a second means for supplying return air from one of the zones to the inlet of the second control chamber, said second means not being in fluid communication with said first control chamber;

mixing means for controlling the flow of air from the first outlet of said first control chamber and the first outlet of said second control chamber to said first zone;

control means for controlling the flow of air from the second outlet of said first control chamber to said second zone;

heater means positioned downstream of said mixing means for selectively heating the air delivered to the first zone;

temperature control means in the first zone for controlling said heater means in response to the temperature in the first zone; and switch means for actuating said mixing means to shut off the flow of air from said first chamber when said heater means is heating air delivered to the first zone.

11. A method for controlling the temperature in first and second volumes comprising:

generating a supply of cool air for delivery to the first plenum of a central terminal having first and second plenums;

delivering return air, under pressure, from one of the volumes to the second plenum of said central terminal;

directing air from the first and second plenums throufh a plurality of mixing dampers attached to the first and second plenums, each communicating with one of a plurality of first volumes to be conditioned;

controlling each mixing damper to control the mixture of air from the first and second plenums to the first volumes;

directing air from the first plenum through control dampers attached to the first plenum, each communicating with one of a plurality of second volumes; and varying the volume of air flow from the first plenum through the control dampers to the second volumes to provide a volume of cool air to the second volumes.

12. The method of claim 11 further comprising:

selectively controlling the mixing dampers in accordance with the temperature in the first volumes to vary the mixture of cool air and return air to the first volumes to control the temperature therein.

13. The method of claim 11 further comprising:

selectively controlling the quantity of air delivered through the control dampers to the second volumes in accordance with the temperature in the second volumes to control the temperature in the second volumes.

14. The method of claim 11 further comprising:

varying the mixture of air from the first and second plenums through the mixing dampers in accordance with the temperature of the first volumes to thereby provide a variable temperature, constant volume of air to the first volumes for controlling the temperature of the volumes.

15. The method of claim 11 further comprising:

varying the quantity of air delivered from the first plenum through the control dampers to the second volumes in accordance with the temperature of the second volumes, thereby providing a constant temperature, variable quantity of air to the second volumes.

16. The method of claim 11 further comprising:

maintaining a predetermined constant pressure in the first plenum.

17. The method of claim 11 further comprising:

maintaining a predetermined constant pressure in the second plenum.

18. The method of claim 11 further comprising:

stopping the flow of air from the first plenum to selected ones of the first volumes and heating the air from the second plenum to the selected ones of the first volumes in accordance with the temperature of the first volumes; and delivering the heated air to these selected first volumes.

* * * * *